United States Patent [19]

Gamblin et al.

[11] Patent Number: 4,767,509

[45] Date of Patent: Aug. 30, 1988

[54] NICKEL-PHOSPHORUS ELECTROPLATING AND BATH THEREFOR

[75] Inventors: Rodger L. Gamblin, Dayton; Nancy E. Myers; David J. Sugg, both of Kettering, all of Ohio

[73] Assignee: Burlington Industries, Inc., Greensboro, N.C.

[21] Appl. No.: 62,641

[22] Filed: Jun. 16, 1987

Related U.S. Application Data

[63] Continuation-in-part of Ser. No. 732,277, May 9, 1985, Pat. No. 4,673,468, and Ser. No. 609,137, May 11, 1984, abandoned, which is a continuation-in-part of Ser. No. 458,461, Jan. 17, 1983, abandoned, and Ser. No. 499,515, May 31, 1983, abandoned, which is a continuation-in-part of Ser. No. 464,101, Feb. 4, 1983, Pat. No. 4,528,070.

[51] Int. Cl.[4] ..... C25D 3/58

[52] U.S. Cl. ..... 204/44.7; 106/1.27

[58] Field of Search ..... 204/44.7; 106/1.27

[56] References Cited

U.S. PATENT DOCUMENTS

| | | | |
|---|---|---|---|
| 2,069,566 | 2/1937 | Tuttle et al. | 204/14 |
| 2,633,631 | 4/1953 | Horvitz | 29/196.1 |
| 2,643,221 | 6/1953 | Brenner et al. | 204/44.7 |
| 2,684,892 | 7/1954 | Saulnier | 44/52 |
| 2,739,107 | 3/1956 | Ricks | 204/37 |
| 3,041,254 | 6/1962 | Pedler | 204/49 |
| 3,041,255 | 6/1962 | Passal et al. | 204/49 |
| 3,104,167 | 9/1963 | Cotteta | 75/97 |
| 3,192,136 | 6/1965 | Reid | 204/11 |
| 3,303,111 | 2/1967 | Peach | 204/38 |
| 3,449,221 | 6/1969 | Thomas | 204/15 |
| 3,475,293 | 10/1969 | Haynes et al. | 324/48 |
| 3,507,243 | 4/1970 | Brown | 114/218 |
| 3,658,569 | 4/1972 | Philipp et al. | 117/47 R |
| 3,759,803 | 9/1973 | DuRose et al. | 204/49 |
| 3,817,774 | 6/1974 | Kuzmik | 117/47 A |
| 3,847,681 | 11/1974 | Waldman | 148/11.5 |
| 3,856,653 | 12/1974 | Rogers et al. | 204/286 |
| 3,956,097 | 5/1976 | de Nora et al. | 204/252 |
| 4,022,679 | 5/1977 | Koziol et al. | 204/286 |
| 4,033,831 | 7/1977 | Bakewell | 204/11 |
| 4,042,382 | 8/1977 | Feldstein | 75/170 |
| 4,077,864 | 3/1978 | Vanderveer et al. | 204/285 |
| 4,086,149 | 4/1978 | Matinsons et al. | 204/59 R |
| 4,106,975 | 8/1978 | Berkenblit et al. | 156/628 |
| 4,106,976 | 8/1978 | Chiou et al. | 156/644 |
| 4,108,739 | 8/1978 | Tadokoro et al. | 204/40 |
| 4,113,248 | 9/1978 | Yanagioka | 273/72 A |
| 4,127,709 | 11/1978 | Ruben | 429/245 |
| 4,160,049 | 7/1979 | Narcus | 427/277 |
| 4,169,008 | 9/1979 | Kurth | 156/600 |
| 4,184,925 | 1/1980 | Kenworthy | 204/11 |
| 4,224,133 | 9/1980 | Takahashi | 204/290 R |
| 4,229,265 | 10/1980 | Kenworthy | 204/11 |
| 4,374,707 | 2/1983 | Pollack | 204/11 |
| 4,380,493 | 4/1983 | Wortley et al. | 204/105 M |
| 4,528,070 | 7/1985 | Gamblin | 204/11 |
| 4,529,668 | 7/1985 | Croopnick et al. | 428/665 |

FOREIGN PATENT DOCUMENTS

| | | |
|---|---|---|
| 55-31181 | 3/1980 | Japan . |
| 50190 | 3/1984 | Japan . |
| 1240260 | 7/1971 | United Kingdom . |

OTHER PUBLICATIONS

"Chemical Engineers' Handbook", 5th Ed., 1973, R. H. Perry et al., pp. 23.26–27.

"Handbook of Thin Film Technology", Maissel et al., Chapter 7 (1970).

"Electroplating Engineering Handbook", A. K. Grahm, 3rd. Ed., pp. 486–507 (1981).

"Electrodeposition of Alloys", A. Brenner, vol. II, Chapter 35 (1963).

"Unitized In Line Electron Gun", Bozzay et al., U.S. Patent 4,096,408. 1970.

"Electroformed Bulk Ni–P Metallic Glass", Mayer et al., Plating and Surface Finishing, Nov. 1985, pp. 76–80.

Hipp, "Production and Properties of Nickel–Phosphorus Alloy Coatings on Aluminum Structural Components", Aluminum, 1978, 54(10), 654–655.

Fields et al., "Electroless Nickel Plating", pp. 219–243.

F. Carlin, "Nickel Plating", 39th Metal Finishing Guide Book Directory for 1971, pp. 312–335.

G. S. Cargill, III, "Structural Investigation of Noncrystalline Nickel–Phosphorus Alloys", Journal of Applied Physics, vol. 41, No. 1, 1970.

Brenner et al., "Electrodeposition of Alloys of Phosphorus with Nickel or Cobalt", Research Paper RP2061, vol. 44, Jan. 1950.

*Primary Examiner*—R. L. Andrews

*Attorney, Agent, or Firm*—Nixon & Vanderhye

[57] ABSTRACT

An all chloride bath is provided for electroplating nickel phosphorus on a substrate. The bath includes 0.7–1.3 molar $Ni^{+}$, 1–2 molar $Cl^{-}$, and 1–3 molar $HPO_3^{+2}$. The bath also optionally contains 0.2–0.6 molar $PO_4^{-3}$. The bath contains as little sulfate as possible. Any sodium lauryl sulfate in the bath can be removed using a carbon filter. The electroplatings produced according to the invention have Knight shift, density, and non-uniform thickness properties more characteristic of electroplated nickel phosphorus than electroless. They have lower tensile strength, increased inherent brightness, and reduced graininess compared to electroplating from baths including sulfate. The bath has increased cathode efficiency, increased conductivity, and reduced formation of unwanted precipitates compared to baths with sulfates. The bath constituents may be provided from $NiCl_2.6H_2O$ and $H_3PO_3$; or from $Ni(H_2PO_3)_2$ and HCl.

19 Claims, No Drawings

NICKEL-PHOSPHORUS ELECTROPLATING AND BATH THEREFOR

CROSS REFERENCE TO RELATED APPLICATION

This application is a continuation-in-part of Ser. No. 732,277 filed May 9, 1985, now U.S. Pat. No. 4,673,468. This application is also a continuation-in-part of application Ser. No. 609,137 filed May 11, 1984, now abandoned, which in turn is a continuation-in-part of each of applications Ser. Nos. 458,461 filed Jan. 17, 1983 (abandoned) and 499,515 filed May 31, 1983, abandoned, which in turn is a continuation-in-part of application Ser. No. 464,101 filed Feb. 4, 1983 now Pat. No. 4,528,070.

BACKGROUND AND SUMMARY OF THE INVENTION

In the production of nickel phosphorus electroplatings, it has been conventional procedure to use a so-called "Brenner bath" which typically adds nickel in a sulfate form, to provide a part of the constituents of the bath. Brenner's work is reported in his treatise *Electrodeposition of Alloys: Principles and Practice,* Vol. II, Abner Brenner, Academic Press, 1963, pp. 457–483. There, in Table 35–1, he describes sulfate-containing baths for electrodepositing nickel-phosphorus. It has been found, however, that such "sulfate" baths have relatively poor cathode efficiency, relatively poor bath conductivity (thereby requiring a higher voltage to properly effect plating), and because the sulfate is less soluble than desirable, it forms unwanted precipitates in the bath. Also, baths according to Brenner result in nickel phosphorus platings that have higher tensile stress than desired, less inherent brightness than desired, and a graininess.

According to the present invention, it has been found that all of the above-mentioned deficiencies can be overcome by providing the correct bath constituents, and operating a bath in an appropriate manner to maintain the desired balance between constituents. According to the invention an "all chloride" bath is provided. The bath according to the invention has almost no sulfate. Any sulfate that is present is present in such small quantities that it does not result in the adverse properties set forth above.

The bath according to the present invention includes 0.7–1.3 molar $Ni^+$, 1–2 molar $Cl^-$, and 1–3 molar $HPO_3^{+2}$. The bath may also include 0.2–0.6 molar $PO_4^{-3}$. Some cobalt also may be present, either as a common contaminant of the nickel, or in specified amounts. Typically the bath would have a significantly higher proportion of nickel than cobalt. The bath most typically would be prepared from $NiCl_2.6H_2O$ and $H_3PO_3$, or from $Ni(H_2PO_3)_2$ and HCl.

The bath according to the present invention has increased cathode efficiency, and conductivity with respect to the Brenner "sulfate" bath, and because the components are more soluble, unwanted precipitates are not in the bath. Further, the nickel phosphorus platings produced from the bath according to the invention have higher inherent brightness, less tensile stress and less "graininess" than "sulfate" baths. One particularly useful bath according to the invention for achieving the desired results comprises: about 1.25 molar $H_3PO_3$, about 0.3 molar $H_3PO_4$, about 0.9 molar $NiCl_2$, and about 0.25 molar $NiCO_3$.

According to the present invention a method is provided for electroplating a nickel phosphorus alloy on a substrate. The method comprises the following steps: (a) Providing a bath comprising 0.7–1.3 molar $Ni^+$, 1–2 molar $Cl^-$, and 1–3 molar $HPO_3$, and minimal amounts of sulfate. (b) Immersing a substrate as a cathode in the bath. (c) Immersing an anode in the bath. And (d) applying an electrical potential across the anode and cathode so as to effect electrodeposition of nickel phosphorus alloy on the substrate, with increased cathode efficiency, increased conductivity, and minimal unwanted precipitates, compared to the results of the use of baths containing significant amounts of sulfate.

In accordance with the teachings of said parent application Ser. No. 732,277 now U.S. Pat. No. 4,673,468 (the disclosure of which is hereby incorporated by reference herein) the phosphoric acid concentration is controlled (kept below 0.5 molar). The bath is kept with an acid titer range of about 9–14, and the anode current density is maintained very high. Typically the anode current density is maintained so that it is always greater than about 200 amperes per square foot. At levels significantly below about 200 amperes per square foot, the desired control of the phosphoric acid buildup and/or free acid concentration does not occur. In fact, anode current densities of at least about 500 amperes per square foot for nickel phosphorus coating baths are preferred. Anode current densities as high as 1250 amperes per square foot are useful, and apparently the upper limits on anode current density are determined by non-electrochemical constraints, such as $I^2R$ heating, corrosion of accessory electrical components (such as bus bars) at higher voltages, etc.

The anode configuration is chosen so that the desired anode current density is achieved. Typically the anode will be of platinum or rhodium. Anode configurations as in said co-pending application Ser. No. 732,277 now U.S. Pat. No. 4,673,468 are suitable, as are those in co-pending application Ser. No. 609,137 filed May 11, 1984 "Anode Configuration With Nickel Phosphorus Electroplating" (attorney dkt. 11/489). Alternatively, the bath described in U.S. patent application Ser. No. 923,270 filed Oct. 27, 1986, the disclosure of which is incorporated by reference herein, may be used to obtain a more ductile form of the nickel-phosphorus electroplating.

It is the primary object of the present invention to provide an electrochemical bath for electroplating nickel phosphorus alloy onto a substrate that has numerous advantages compared to "sulfate" baths, and to provide nickel phosphorus electroplatings that are advantageous compared to prior art electroplatings. This and other objects of the invention will become clear from an inspection of the detailed description of the invention and from the appended claims.

DETAILED DESCRIPTION OF THE INVENTION

It has been found that if the anode current density is maintained at a high enough level, the oxidation of phosphorous acid to phosphoric acid within the plating bath is controlled such that there is essentially no increase in the level of phosphoric acid within the bath, so that deleterious effects that result from an increasing concentration of $H_3PO_4$ are avoided, and/or the free acid concentration is controllable so that it is in an acid titer range of about 9–14. If the bath of the above-mentioned application Ser. No. 923,270 is used, the acid titer is preferably maintained in a range of about 22 to 30. The bath can have an indefinite life as long as phosphorous acid and sources of nickel are added. These sources initially are preferably in the form of $NiCl_2$ to promote conductivity, together with lesser amounts of $NiCO_3$. Makeup sources during plating preferably are $NiCO_3$ to avoid chloride buildup in the bath while evolving $CO_2$. Preferably, according to the method of the present invention, the anode current density is maintained at a minimum level of about 200 amperes per square foot, with a preferred anode current density, particularly for nickel phosphorus plating, of a minimum of about 500 amperes per square foot. The desired high anode current density may be achieved according to the present invention by utilizing an anode of small effective area, utilizing various anode configurations.

A typical bath according to the invention comprises 0.7–1.3 molar $Ni^+$, 1–2 molar $Cl^-$, and 1–3 molar $HPO_3^{+2}$. The bath also preferably includes 0.2–0.6 molar $PO_4^{-3}$. The bath may contain small amounts of cobalt, too. The bath is typically made from $NiCl_2.6H_2O$ and $H_3PO_3$, or $Ni(H_2PO_3)_2$ and HCl.

Alternatively, using the bath of application Ser. No. 923,270 the bath will include about 0.5–1.0 molar nickel, about 1.5–3.0 molar phosphorous acid, about 0.1–0.6 molar phosphoric acid and about 0–0.6 molar hydrochloric acid.

It has been found that if sodium lauryl sulfate—a surfactant that is commonly used as a sizing on polypropylene filter media—is present in the bath, it adversely affects plating ductility. Therefore its presence should be avoided, and if a bath tests for it, it should be removed by filtration of the bath using a carbon filter.

Examples of the practice of the method according to the present invention, utilizing baths according to the present invention, are as follows:

EXAMPLE 1

An initial bath formulation comprising 1.25 molar $H_3PO_3$, 0.30 molar $H_3PO_4$, 0.90 molar $NiCl_2$, and 0.25 molar $NiCO_3$, was provided. Two anodes having platinum strips were provided, and the cathode-workpiece being plated was a 1.8 meter long plate. A number of plates were consecutively plated, with sufficient $NiCO_3$ and phosphorous acid being added at intervals to replenish the nickel and phosphorus components of the bath. $H_3PO_4$ concentration readings were taken at various points of time, and were 0.31, 0.31, 0.28, and 0.30 molar respectively. Nickel phosphorus coatings produced were amorphous, with a high concentration (viz. about 20+ atomic percent) of phosphorus. The anode current density was about 1,000 amperes per square foot, with an anode amperage of 88 amperes.

EXAMPLE 2

A bath was made up which included $CoCl_2$ in addition to the $NiCl_2$, with the $CoCl_2$ and $NiCl_2$ combined making up 0.75 molar. The other constituents of the bath were the same as set forth in Example 1. Anode current density was maintained in the range of 250–500 amperes per square foot, with the anode current density not being increased significantly above 500 amperes per square foot to ensure that oxidation of $Co^{+2}$ to $Co^{+3}$ did not occur. Good quality nickel cobalt phosphorus coatings were produced.

EXAMPLE 3

A bath was made up containing 0.75 molar $NiCl_2$, 0.25 molar $CoCO_3$, 1.2 molar phosphorous acid, and 0.2 molar phosphoric acid. The bath was held at a temperature of about 80° C. The cathode-workpiece was a carbon steel knife which was cleaned by brief immersion in an alkaline cleaning solution and scrubbed and reimmersed in the alkaline cleaning solution, and then dipped in a 10% sulfuric acid solution. The knife was then immersed in the bath. The plating formed on each side of the knife edge was approximately 1/1000th of an inch thick, with the nickel cobalt phosphorus amorphous alloy actually forming the cutting edge. The knife was useful for its intended purpose, and was extremely corrosion resistant due to the nickel cobalt phosphorus alloy coating.

EXAMPLE 4

An aluminum substrate was thoroughly cleansed of all organic material and any residual smut or dirt. harsh acids or alkalis were not used when cleaning the aluminum surface, but rather trichloroethylene and a mildly alkaline cleaning solution were utilized, with a rinse in a weak acid solution. The aluminum was placed at room temperature in a 3% by volume solution of 85% phosphoric acid and water while being attached to the positive terminal of an electrical power supply set to 10 volts. After the amount of current flowing gradually fell off, the aluminum was removed and found to have a phosphate coating. The aluminum was then rinsed with deionized water and the part was then placed as a cathode in a nickel phosphorus bath consisting of 0.75 molar nickelous chloride, 0.25 molar nickel carbonate, 1.2 molar phosphorous acid, and 0.2 molar phosphoric acid. The bath was held at a temperature of about 78° C. The aluminum part became coated smoothly and regularly with a coating of amorphous nickel phosphorus, and which tightly adhered so that the 180° bending subsequent to coating the amorphous coating only showed minor cracking. The part was suitable for uses to which aluminum is commonly put (such as electrical conductors or structural members), but had a nickel phosphorus corrosion- and wear-resistant coating.

EXAMPLE 5

A plating bath was formed with the following composition:

0.75 M/1 $NiCl_2.6H_2O$
0.25 M/1 $NiCO_3$
1.25 M/1 $H_3PO_3$

An electrically conductive substrate was immersed in the bath, which was maintained at a temperature of about 80° C., and with a current density at the cathode of about 150 ma/cm$^2$. When removed from the bath, the substrate had an amorphous nickel-phosphorus alloy thereon. A one (1) microinch strike of gold was provided on the amorphous alloy. The electrical contact surface that resulted had a contact resistance that was substantially as low as a similar substrate with a 50 microinch or greater coating of gold, the contact resistance was stable over time, and as stable in corrosive environments (such as when subjected to the $SO_2$ test—100 percent relative humidity and 1 percent concentration of sulfur dioxide, room temperature, over forty hours—, and the mixed gas test—the same conditions as the $SO_2$ test only adding 1 percent nitrogen dioxide and 1 percent chlorine). The electrical contact surface formed was much less expensive than the conventional one, and had better solderability characteristics.

The baths according to the present invention have higher cathode efficiency, higher bath conductivity, and less unwanted precipitates than the "sulfate" bath. Also, the electroplatings produced according to the invention, compared to those from a "sulfate" bath, have lower tensile stress, higher inherent brightness, and less "graininess". "Graininess" is a visually observed phenomenon associated with the tendency of the plating to form in a multiplicity of small nodules. The nickel phosphorus electroplatings according to the invention typically have a phosphorus content of greater than 20 atomic percent. They have Knight shift, density, and non-uniform thickness properties more characteristic of conventional electroplated nickel phosphorus than electroless nickel phosphorus. In addition, the platings are highly corrosion resistant; including resistance to corrosion by hot ferric chloride and concentrated nitric acid.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent baths, products, and procedures.

What is claimed is:

1. An electroplating bath for plating a nickel phosphorus alloy on a substrate, comprising 0.7–1.3 molar $Ni^+$, 1–2 molar $Cl^-$, and 1–3 molar $HPO_3^{+2}$, with minimal amounts of sulfate so that the cathode efficiency is increased, the bath conductivity is increased, and the formation of unwanted precipitates is minimized compared to a bath containing significant amounts of sulfate.

2. A bath as recited in claim 1 further comprising 0.2–0.6 molar $PO_4^{-3}$.

3. A bath as recited in claim 2 further comprising small amounts of cobalt.

4. A bath as recited in claim 2 consisting essentially of nickel chloride, phosphoric acid and phosphorous acid.

5. A bath as recited in claim 2 containing about 1.25 molar $H_3PO_3$, about 0.3 molar $H_3PO_4$, about 0.9 molar $NiCl_2$, and about 0.25 molar $NiCO_3$.

6. A bath as recited in claim 1 wherein constituents are provided from $NiCl_20.6H_2O$, and $H_3PO_3$.

7. A bath as recited in claim 1 wherein the constituents are provided primarily by $Ni(H_2PO_3)_2$ and HCl.

8. A method of electrolytically plating a nickel phosphorus alloy on a substrate comprising the steps of:

(a) providing a bath comprising 0.7–1.3 molar $Ni^+$, 1–2 molar $Cl^-$, and 1–3 molar $HPO_3^{+2}$, and minimal amounts of sulfate;

(b) immersing a substrate as a cathode in the bath;

(c) immersing an anode in the bath; and (d) applying an electrical potential across the anode and cathode so as to effect electrodeposition of nickel phosphorus alloy on the substrate, with increased cathode efficiency, increased conductivity, and minimal unwanted precipitates, compared to the results of the use of baths containing significant amounts of sulfate.

9. A method as recited in claim 8 wherein step (a) is further practiced by providing in the bath 0.2–0.6 molar $PO_4^{-3}$.

10. A method as recited in claim 8 wherein step (d) is further practiced by maintaining the anode current density at a minimum of about 200 amperes per square foot.

11. A method as recited in claim 9 wherein step (d) is further practiced by maintaining the anode current density at a minimum of about 200 amperes per square foot.

12. A method as recited in claim 9 wherein step (d) is further practiced by maintaining the anode current density at a minimum of about 500 amperes per square foot.

13. A method as recited in claim 9 wherein step (a) is practiced by initially forming the bath utilizing $NiCl_2.6H_2O$ and $H_3PO_3$.

14. A method as recited in claim 9 wherein step (a) is practiced by initially forming the bath utilizing $Ni(H_2PO_3)_2$ and HCl.

15. A method as recited in claim 9 comprising the further step of filtering out any sodium lauryl sulfate that becomes deposited in the bath, utilizing a carbon filter.

16. An amorphous nickel phosphorus electroplating produced by practicing the steps comprising:

(a) providing a bath comprising 0.7–1.3 molar $Ni^+$, 1–2 molar $Cl^-$, and 1–3 molar $HPO_3^{+2}$, and minimal amounts of sulfate; (b) immersing a substrate as a cathode in the bath; (c) immersing an anode in the bath; and (d) applying an electrical potential across the anode and cathode so as to effect electrodeposition of nickel phosphorus alloy on the substrate, with increased cathode efficiency, increased conductivity, and minimal unwanted precipitates, compared to the results of the use of baths containing significant amounts of sulfate.

17. An amorphous nickel phosphorus electroplating as recited in claim 16 having Knight shift, density, and non-uniform thickness properties more characteristic of electroplated nickel phosphorus than electroless nickel phosphorus, and having lower tensile stress, increased inherent brightness, and reduced graininess compared to electroplatings produced from baths containing significant amounts of sulfate.

18. An amorphous nickel phosphorus electroplating on a substrate, the electroplating having Knight shift density, and non-uniform thickness properties more characteristic of electroplated nickel phosphorus than electroless nickel phosphorus, and having lower tensile stress, increased inherent brightness, and reduced graininess compared to electroplating produced from baths containing significant amounts of sulfate, said electroplating having a phosphorus content of at least about 20 atomic percent.

19. An electrochemical bath consisting essentially of about 1.25 molar $H_3PO_3$, about 0.3 molar $H_3PO_4$, about 0.9 molar $NiCl_2$, and about 0.25 molar $NiCO_3$.

* * * * *

UNITED STATES PATENT AND TRADEMARK OFFICE

CERTIFICATE OF CORRECTION

PATENT NO. : 4,767,509

DATED : August 30, 1988

INVENTOR(S) : RODGER L. GAMBLIN; NANCY E. MYERS; DAVID J. SUGG

It is certified that error appears in the above-identified patent and that said Letters Patent is hereby corrected as shown below:

Cover page, under "Other Publications" entitled "Brenner et al., through Jan. 1950" should read --Brenner et al., "Electrodeposition of Alloys of Phosphorus with Nickel or Cobalt", J. Research Nat'l. Bur. Standards, Vol. 44, Jan. 1950, RP 2061--. Abstract, line 4, $HPO_3^{+2}$ should read $HPO_3^{-2}$. Column 1, line 52, $HPO_3^{+2}$ should read $HPO_3^{-2}$; line 60, delete the comma after "efficiency". Column 2, line 7, $HPO_3$ should read $HPO_3^{-2}$; line 20, "with" should read --within--. Column 3, line 21, $HPO_3^{+2}$ should read $HPO_3^{-2}$. Column 4, line 21, "harsh" should read --Harsh--; line 56, "ma" should read --mA--; lines 64 and 65, the word "test" should not be divided. Column 5, line 34, $HPO_3^{+2}$ should read $HPO_3^{-2}$; line 55, $HPO_3^{+2}$ should read $HPO_3^{-2}$. Column 6, lines 22 and 23, the chemical symbols $Ni(H_2PO_3)_2$ should not be divided; line 32, $HPO_3^{+2}$ should read $HPO_3^{-2}$; line 51, a comma should be inserted after the word "shift".

Signed and Sealed this

Twenty-second Day of August, 1989

*Attest:*

DONALD J. QUIGG

*Attesting Officer*

*Commissioner of Patents and Trademarks*